US005257806A

United States Patent [19]

Linden

[11] Patent Number: 5,257,806

[45] Date of Patent: Nov. 2, 1993

[54] BALANCED BOWLING BALL

[76] Inventor: Charles F. Linden, 3465 Higley Rd., Rocky River, Ohio 44146

[21] Appl. No.: 693,137

[22] Filed: Apr. 29, 1991

Related U.S. Application Data

[63] Continuation-in-part of Ser. No. 591,207, Oct. 1, 1990, abandoned.

[51] Int. Cl.[5] ..... A63B 37/06

[52] U.S. Cl. ..... 473/126

[58] Field of Search ..... 273/63 E, 63 R, 63 C, 273/63 D

[56] References Cited

U.S. PATENT DOCUMENTS

| | | | |
|---|---|---|---|
| 3,441,274 | 4/1969 | Collins | 273/63 E |
| 3,865,369 | 2/1975 | Randolph | 273/63 E |
| 4,121,828 | 10/1978 | Amburgey | 273/63 E |
| 4,320,899 | 3/1982 | Salvino | 273/63 E |
| 4,913,429 | 4/1990 | Fabanich | 273/63 E |
| 5,058,901 | 10/1991 | Salvino | 273/63 E |

*Primary Examiner*—George J. Marlo
*Attorney, Agent, or Firm*—Woodling, Krost & Rust

[57] ABSTRACT

A positive weighted balanced bowling ball is disclosed which comprises a spherical member which, for reference purposes, has a positive half and a negative half. A center weight in the shape of a segment of a sphere is located in the negative half of the member and a side weight in the shape of a segment of a sphere resides in the positive half of the spherical member. A top weight resides partially in the positive half and partially in the negative half of the member and the ball is provided with finger and thumb holes for gripping and manipulating the bowling ball. The center weight is of larger mass than the side weight and is located relatively close to the center of the ball whereas the side weight is located in a portion of the positive half relatively further from the center and near the exterior of the spherical member. The center weight and side weight are balanced when the bowling ball is at rest, and their centers of gravity and radii are considered.

9 Claims, 4 Drawing Sheets

BALANCED BOWLING BALL

This application is a continuation-in-part of U.S. patent application Ser. No. 07/591,207 filed Oct. 1, 1990 entitled Positive Triple Weighted Bowling Ball Weight Block filed in the name of Charles F. Linden, now abandoned.

FIELD OF THE INVENTION

A bowling ball is selected for bowler, then is fitted and drilled. This ball can be drilled for each and every different type of roll, hook, or curve. This procedure is done by rotating the grip over the center of the label on each bowling ball. Positioning the grip with respect to the positive weight block results in different ball action. This results in a different type of ball action because of the geometric spin of the positive axis weight block.

BACKGROUND OF THE INVENTION

This present invention has to do with positive weight and leverage weight balancing of bowling balls. This new concept will help the new rule that the American BOWLING Congress is trying to pass in 1992. This rule pertains to keeping the drilling patterns over the manufactured labels on the bowling balls. The new weight block design will make drilling and balancing easier for selected ball weights for different reactions. This new concept will also make it easier for bowlers to adjust to the new short oil conditions that A.B.C. has adopted since 1985. The different drillings that can be used will change the roll on the bowling balls pictured on FIGS. 4, 5, 6. This new ball will help pro shop owners to select one type ball and get three to four different hooking actions, just by drilling the bowling balls differently over the labels.

DESCRIPTION OF THE PRIOR ART

The theory of the new weight block is to help bowlers to determine what hooking action they would like to use on the present lane conditions. The different ball drilling patterns will create different reactions even if all bowling balls are balanced the same. In this theory all bowlers will have less problems adjusting and controlling their bowling balls because of the even roll and the smooth reaction of each bowling ball.

SUMMARY OF THE INVENTION

This is a tri-block bowling ball with a double pinned weight block for better balance and perfect distribution of weight. This ball also can be drilled many different ways to give each bowler the reaction he or she is looking for in their game. This is a way to give the bowling ball a gyroscopic action without moving the drilling away from the manufactured label. This ball will be dynamically balanced with positive axis and leverage block weight for your personal drilling measurements. This ball was designed to give bowlers the roll and action that they need for scoring and the necessary hitting power needed in today's game of bowling.

No. 10 The outside of the bowling ball. Surface is hard or soft urethane.

No. 15 The pour spots or plugs spots for holding the weight blocks in place during manufacturing.

No. 20 Top weight for better balancing on ball. Plus weight in the top of the ball after being drilled.

No 25 Center weight block is larger of the two inward blocks in the center of the ball.

No. 30 Plastic drill rod ½" to hold the weight blocks in place when pouring ball in mold.

No. 35 Side weight block that gives the ball the maximum roll, hook, and gyration.

No. 40 These are drilled holes to show different drilling patterns.

DESCRIPTION OF THE PREFERRED EMBODIMENTS

Figure 1:
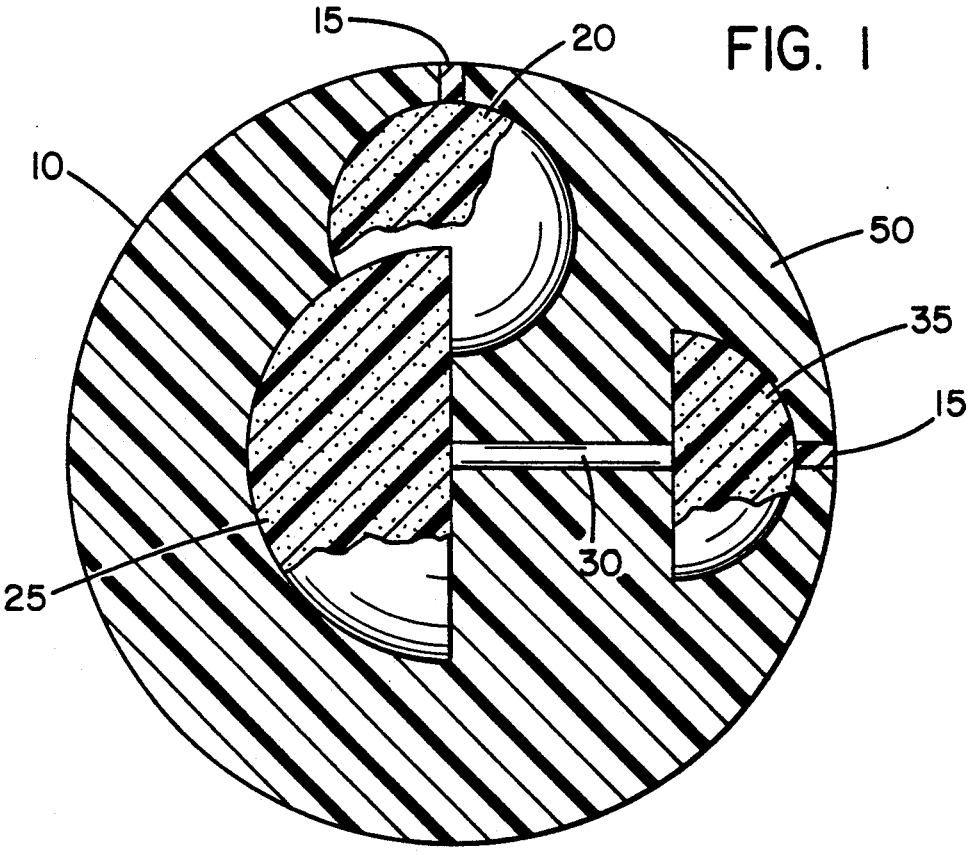
FIG. 1 is a cross sectional view of the bowling ball of the present invention.

A bowling ball, according to the preferred embodiment of the present invention, is shown in FIG. 1 and is designated by the numeral 10. The bowling ball is fashioned from a suitable material which must be tough and durable. This ball features double pin spots for better balance and more accurate pin setting when pouring bowling ball. The top weight block, which provides weight lost in the bowling ball after fingers and thumb are drilled into the balls, is indicated by numeral 20. The center weight block is the main part of the ball. It is larger and heavier than the other weight blocks located near the center of the ball, indicated by numeral 25. The ½" plastic rod is the main support that holds both weight blocks in line for better balancing when ball is being poured, indicated by numeral 30. The smaller weight block, indicated by numeral 35, is the weight that gives the new weight block its gyroscopic action and supreme roll for better pin action. The finger and thumb holes are pictured on different balls to show how each reaction can reached, indicated by numeral 40.

Figure 2:
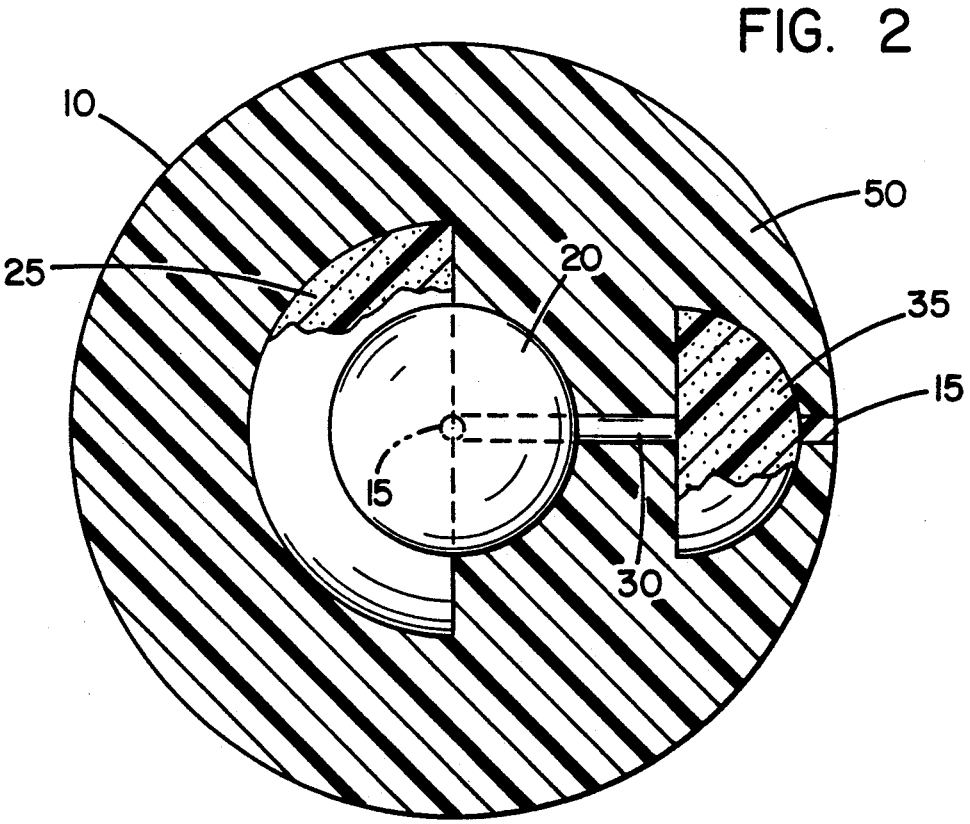
FIG. 2 is a cross sectional view of FIG. 1 taken on the order of 90° or greater from the position of FIG. 1.
Figure 3:
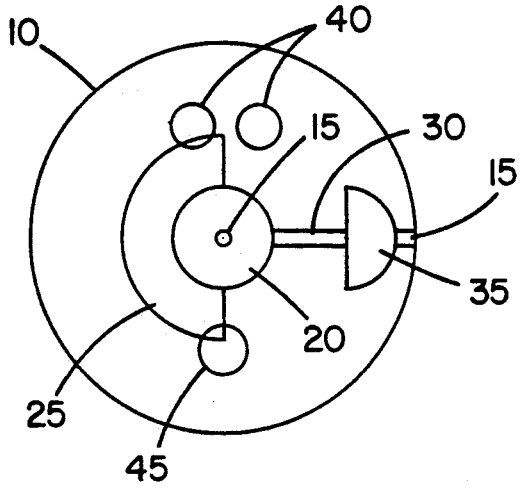
FIG. 3 is a view similar to FIG. 2 illustrating schematically the position of finger holes and thumb hole.
Figure 4:
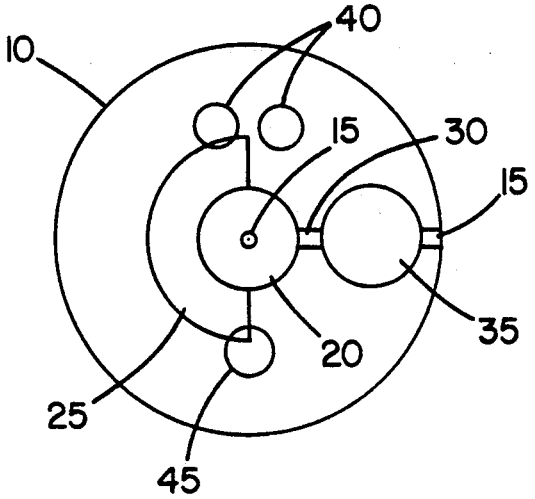
FIG. 4 is a view similar to FIG. 3 illustrating a side weight of a different configuration and illustrating the arrangement to obtain maximum hook and maximum ball reaction.
Figure 5:
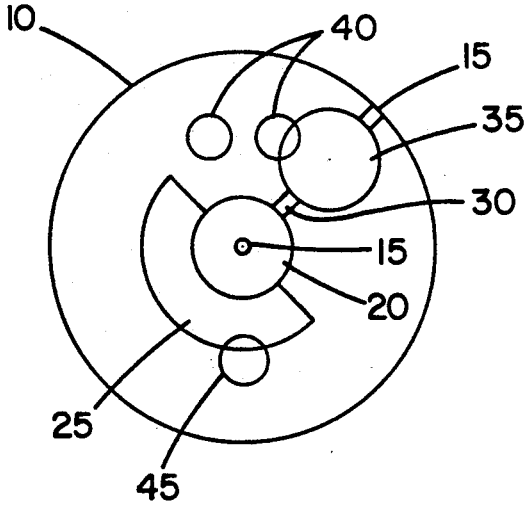
FIG. 5 is a view similar to FIG. 4 illustrating the finger holes and thumb hole in a slightly different relation to the other components of the bowling ball illustrating an arrangement to accomplish medium hook and medium ball reaction.
Figure 6:
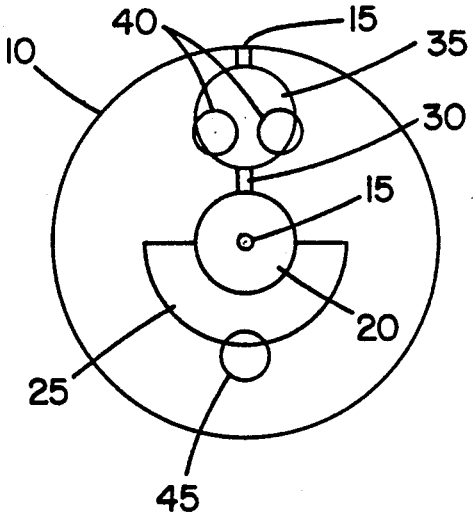
FIG. 6 is a view similar to FIGS. 4 and 5 illustrating yet another relative position of the finger holes and thumb hole illustrating a condition wherein the bowling ball will have very little hook and very little ball reaction in relation to the arrangements of FIGS. 4 and 5.

FIG. 2 shows the top view of the bowling ball. Displayed in the diagram are the pour spots, the top weight block, center weight block, smaller positive weight, and the plastic ½" holding rod. The company's label will be over the weight, indicated by numeral 20. FIG. 3 shows the top view of the bowling ball again, plus finger holes and thumb hole drilled in the bowling ball. FIG. 4 shows the drilling that gives a bowler an early roll and most hook or curve on this ball diagram. FIG. 5 shows the pin spots set at 45° for medium roll, hook, and curve. This drilling gives an even roll and medium hook for most normal conditions. FIG. 6 shows the ball drilled at 90° for very little hook or curve on the ball. This drilling is usually drilled for bowlers that want very little reaction on their bowling ball.

It should be understood to those skilled in the art that the invention herein disclosed can be framed in various embodiments and that the embodiments herein disclosed are not the exclusive embodiments.

FIG. 2 is a top plan view of an embodiment shown without finger holes 40 or a thumb hole 45. FIG. 1 is a side view of FIG. 2. In FIG. 1 the top weight 20 is shown to be spherically shaped. However, in the embodiments shown in FIGS. 7 and 9, the top weight 20 is a segment of a sphere. The embodiments of FIGS. 1-3 employ a hemispherically shaped side weight 35.

It is necessary at this juncture to define a negative half and a positive half of the bowling ball. The terms "negative half" and "positive half" of the bowling ball define the locations of several weights, etc. which are described in relationship to their residence within the spherical member 10. The negative half of the bowling ball is generally shown in FIG. 9 which is taken along line 9—9 in FIG. 8. A center weight 25 resides in the negative half of the ball and is hemispherically shaped. The center weight 25 of the preferred embodiment is heavier than the side weight 35. The center weight 25, although heavier is closer to a center of the bowling ball however, a lighter side weight 35 balances the ball in that it is further away from the center. Additionally, the top weight 20 of the ball partially resides in the negative half of the ball. The other half of the top weight 20 resides in the positive half which is to be discussed below.

Figure 7:
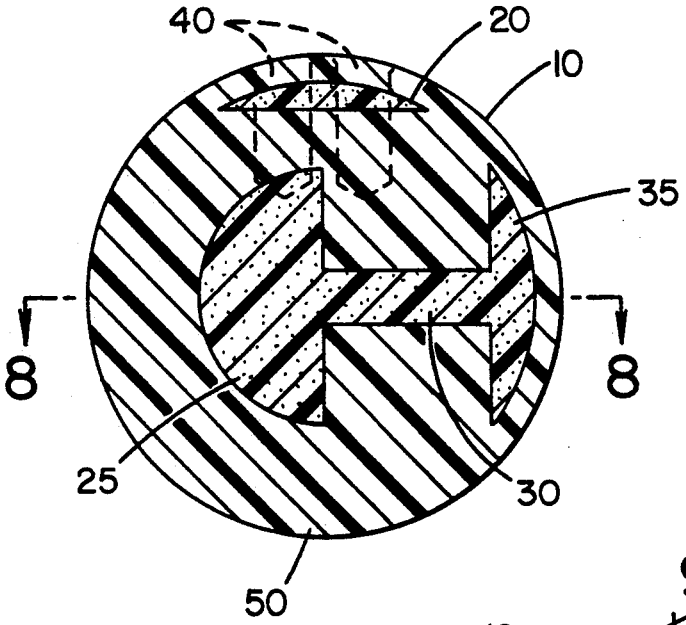
FIG. 7 is a view taken generally along the line 7—7 of FIG. 8 and a cross sectional view of a bowling ball constructed under the teachings of the present invention illustrating the various weights in a different configuration.
Figure 8:
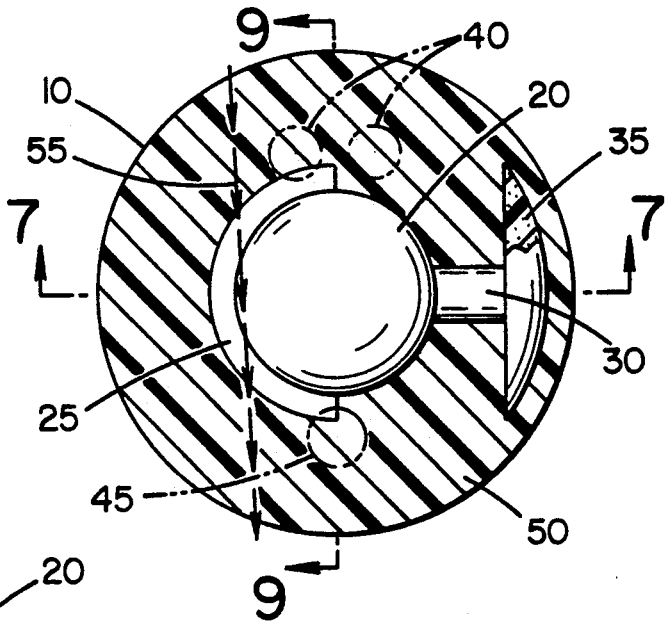
FIG. 8 is a top plan view.
Figure 9:
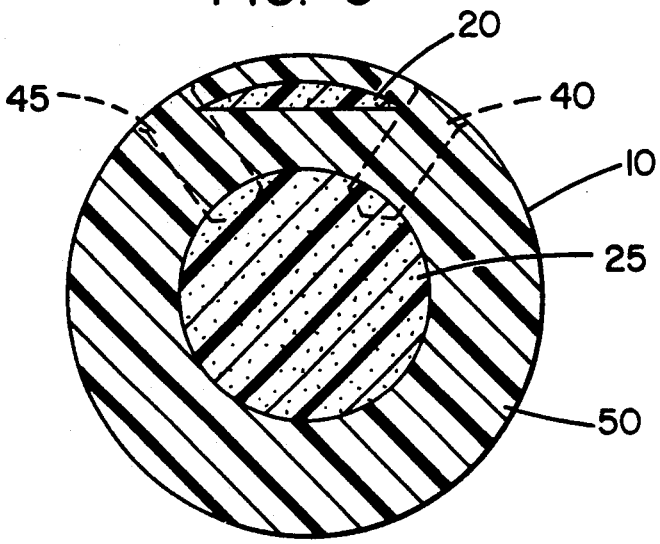
FIG. 9 is a view taken generally along the line 9—9 of FIG. 8.

The top weight 20 is a segment of a sphere in the preferred embodiment of FIGS. 7-9 but could be of different shapes in other embodiments. Further, the hemispherically shaped center weight 25 of the preferred embodiment could be differently shaped in other embodiments. There is no restriction in the present invention as to the location of the center weight 25 to be exclusively in the negative half of the spherical member 10. For instance, those skilled in the art will readily recognize that the center weight could reside partially in the positive half of said spherical member 10.

FIG. 8 is a top plan view. FIG. 9 is a sectional view of the negative half of the ball. In FIG. 8, that portion generally to the left of line 9—9 is the negative half of the bowling ball. Conversely, the positive half of the ball is that portion generally to the right of line 9—9. The positive half is so designated because it is the half which contacts the bowling pins first for a right-handed bowler. The positive half of the ball is sometimes designated the pin side of the ball by those skilled in the art.

It should be noted when examining FIG. 8 that the direction of roll of the ball is from the finger holes 40 towards the thumb hole 45. The ball will generally follow a track 55 as it rolls down the bowling alley. Depending on factors to be discussed below, the track 55 will be of varying width and will result in different actions of the ball.

Figure 10:
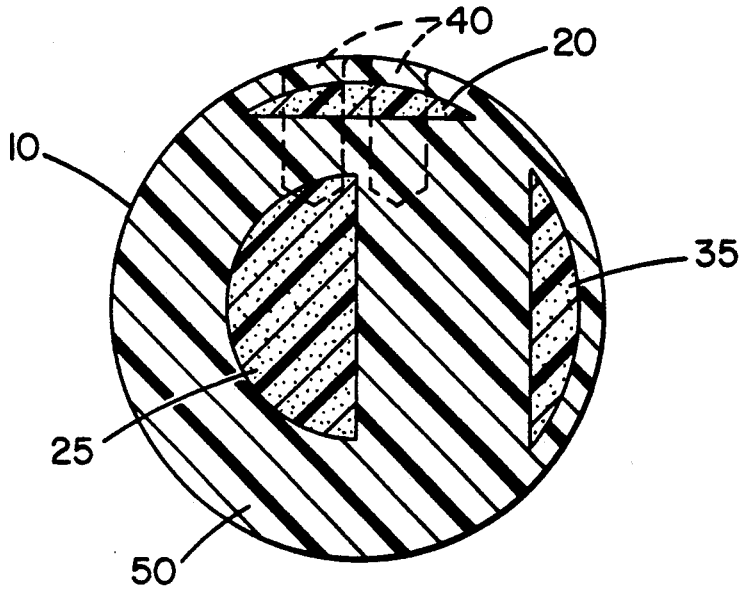
FIG. 10 is a cross sectional view of another embodiment of a bowling ball constructed under the teachings of the present invention; and, FIG. 11 is generally a plan view of the bowling ball shown in FIG. 10.

The side weight 35 in FIGS. 7, 8 and 10 is a segment of a sphere. The side weight 35 is also known as the positive weight. It is known as the positive weight because it resides in the positive half of the ball. It is important to understand that the positive half of the ball is the half which will contact the pins first. The reason that the positive half of the bowling ball strikes the pins first will be explained below.

FIG. 7 is a sectional view taken along the line 7—7 as is indicated in FIG. 8. Top weight 20 in FIG. 7 is shown as a segment of a sphere. Further, the top weight 20 could be described as a "puddle weight" by those skilled in the art. In FIG. 7, finger holes 40 are shown in phantom residing behind the top weight 20.

It will be noted that all of the FIGS. 1-8, inclusive, show a connecting rod 30 between the side weight and the center weight. The connecting rod 30 is a manufacturing convenience. The rod 30 facilitates holding of the parts 25 and 35 in a mold as the ball is manufactured. FIG. 10 shows a side cut-away view (similar to FIG. 7) of the invention without the connecting rod present. It will be noted that the connecting rod is not totally necessary to the invention but is shown for the reasons hereinabove described. Still further, FIGS. 1 and 2 show pour spots or plugs 15 which hold the weights in position during manufacture. These pour spots or plugs are permanently plugged and sealed.

It should be noted that the weights hereinabove described, namely, the top weight 20, the side weight 35, and the center weight 20 as well as the connecting rod 30 reside within the spherical member 10. It will be further understood by those skilled in the art that interiorly to the spherical member 10, exclusive of the weights described above, the spherical member 10 is comprised of a material 50 from which bowling balls are constructed. The top weight 20, side weight 35 and the center weight 25 as well as the connecting rod 30 can be manufactured from many strong, heavy materials such as barium oxide.

Figure 11:
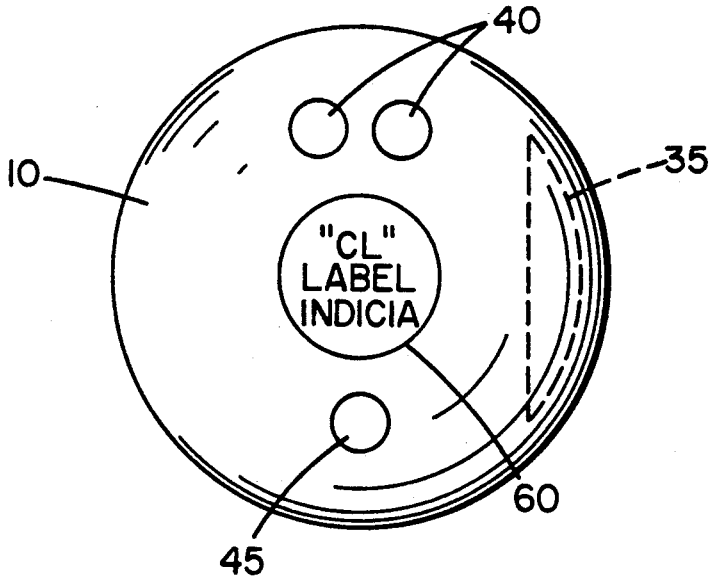

FIGS. 4, 5 and 6 show the side weight to be spherically shaped. FIGS. 3, 4, 5 and 6 are top plan views of the present invention. Further, FIGS. 4, 5 and 6 illustrate different positions of the finger holes 40 relative to the side weight 35. Finger holes 40 and thumb hole 45 can be positioned relative to the hemispherically shaped side weight 35 as that shown in FIG. 3. The finger holes 40 and the thumb hole 45 are positioned relative to the indicia 60 commonly known as a label, FIG. 11. The indicia 60 is positioned relative to the side weight 35 which is shown in phantom in FIG. 11. By knowing the position of the side weight 35 relative to the label, the finger holes 40 and the thumb hole 45 can be positioned so as to obtain the desired ball action.

The present invention, as previously discussed hereinabove, employs positive weight and leverage weight balancing. The side weight 35 is located on the pin side of the bowling ball herein described. The side weight is also known as the positive weight and/or the positive axis weight by those skilled in the art. The positive axis mentioned hereinabove is the axis about which the side weight 35 resides. The pin side of the bowling ball is the side which (during normal use of said ball) strikes the bowling pins after the ball traverses the alley. The leverage block weight mentioned hereinabove is also known as the center weight block 25 and is located on the side opposite said side weight 10. The leverage weight block (also known as the center weight block 25) can also be described as the negative weight block.

In the present invention, the side weight 35 is also known as the positive weight block. The side weight 35 has a mass and a center of gravity in the preferred embodiment which balances the center weight's 25 mass and center of gravity. In the preferred embodiment, FIG. 3, both the side weight 35 and the center weight 25 are generally hemispherically shaped and have different volumes. They are balanced when their center's of gravity and radii are considered.

A unique feature of the present invention is that the weights hereinabove described, to wit, the side weight 35 and the center weight 25, when drilled with finger holes 40 and thumb hole 45, as indicated in the position as shown in FIGS. 3 and 4, produce a stable and early roll of said bowling ball. In bowling the ball is initially at rest before it is thrown down an alley to knock down bowling pins. The bowling ball is put into motion by a person applying force to the bowling ball in the process of throwing it down an alley. The force applied by a person is usually directed toward a desired roll, path, or trajectory of the bowling ball. One problem heretofore encountered by bowlers has been control over the balls. The problem with control over the balls has not, historically, been exclusively with unartful bowlers but has also been with the balls.

Prior to a bowling ball achieving a roll down a bowling alley, a certain amount of skidding and/or sliding takes place. During skidding and/or sliding, the bowler does not have control over the ball and is forced to compensate by throwing and/or aiming the ball differently. A unique advantage of the present invention is that it has unique characteristics to be discussed below which permit it, when configured as in FIGS. 3, 4, 7, 8 and 9 to achieve an early roll, maximize power and control.

It is believed that the unique features of the present invention, and the principles relating thereto, are described in the following paragraphs of this disclosure. However, the invention, standing alone on its structure, has unique advantages over the prior art, irrespective of a complete and total dynamic analysis of the invention.

Rotational inertia of a body depends on the particular axis about which it is rotating as well as on the shape of the body and the manner in which its mass is distributed. It should be noted that in the present invention the top weight 20 is provided for better balancing of the ball when finger holes 40 and thumb hole 45 are drilled. As such, the top weight's inclusion adds to the rotational inertia of the bowling ball that would be lacking without the top weight.

Due to the location and symmetry of the side weight 35 and the center weight 25 about the axis of rotation, (See FIGS. 3, 4, 7, 8 and 9) the rotational inertia of said bowling ball will be lower than other designs disclosed in the prior art. The other designs typically place unbalanced weights at or near the surface of a bowling ball to add to and/or increase the ball's rotational inertia. It is the frictional force of the floor of the alley upon throwing a bowling ball which overcomes the rotational inertia of the ball thus permitting it to roll.

Once the bowling ball of the present invention (shown in FIGS. 3, 4, 7, 8 and 9 as the preferred embodiment) begins to roll, an angular speed will be associated with the bowling ball. Upon the beginning of the roll, the bowling ball's angular speed will initially be zero and then undergo an angular acceleration until it reaches a maximum angular velocity or speed. The angular acceleration is dependent on at least three factors. First, the angular acceleration depends on the force the bowler applies to the ball as he throws it. Second, the angular acceleration is dependent upon the rotational inertia of the bowling ball. Finally, the friction of the bowling alley also affects the angular acceleration of the bowling ball.

In modern bowling there are many different ways to throw a ball. The different ways exist, of course, to produce different rolls. First, of all those skilled in the art will readily recognize that bowlers do not always utilize the full circumference of the ball when bowling. Using the full circumference of a bowling ball can be done, however, if so desired and it can be done with the present invention. When the full circumference of a bowling ball is used, that bowler is known as a full roller. A full roller uses the full circumference of the bowling ball by employing a track that runs between the thumb hole and the finger holes. The track runs between the holes because it is desirous to avoid rolling the ball over the holes since the holes tend to cause the bowling ball to go off course.

Today, however, bowlers commonly throw what is known as a three-quarter roller meaning that they use approximately three-fourths of a bowling ball's circumference when it rolls down an alley. Obviously to those skilled in the art the axis about which the three-quarter roller's ball rotates is not parallel with the floor of the bowling alley. Bowlers prefer the three-quarter roller so as to avoid disturbance to the bowling ball caused by the finger and thumb holes. The path(s) on the circumference of the bowling ball which contact the bowling alley are known as the track of the ball. It is important to note that as a bowling ball progresses down a bowling alley, the track of a ball can and does change. The track 55 of the preferred embodiment is shown in FIG. 8.

The bowling ball of the present invention begins rolling earlier, transferring more angular speed to the ball sooner and causing the side weight member 35 and the center weight member 25, in unison, to rotate creating a gyroscopic effect allowing the bowling ball to stay on a lower track for a longer period of time and with greater accuracy and power. The accuracy of the bowler is enhanced in that the track of the ball is maintained without interference of the finger holes 40 or the thumb hole 45.

It should be noted that all bowling balls, once rolling completely, will begin to lose angular velocity as they proceed down the alley. The angular velocity loss is due to the friction between the ball and the alley floor. The axis of rotation of a bowling ball forms an angle with respect to the bowling alley floor. That angle is largest when the ball reaches its highest angular velocity and decreases thereafter due to a loss in angular velocity. As angular velocity decreases, the ball proceeds down the alley, the axis upon which the ball is rotating changes slightly causing the ball to roll on a slightly higher track 55. Put another way, this means that for every revolution of the ball about its axis, a longer path or track on the bowling ball is realized. By higher track it is meant that more of the circumference of the bowling ball is used. As this happens, in the present invention, the bowling ball as shown for a right handed bowler, will have its track 55 proceed higher on the ball causing it to change course, to wit, hook. A hook for a right handed bowler means that the ball changes course and direction from right to left as it proceeds down the alley. Additionally, as angular velocity increases slightly, and the effect of gyration increases slightly, additional rectilinear motion or speed of the ball is achieved causing the ball to hit the pins and strike them harder and with more efficiency.

It can readily be seen by those skilled in the art that several embodiments of the present invention are possible without deviating from the scope and nature of the above described invention. Further, it should be readily understood that the side weight member 35 and the center weight member 25 can be of different shapes, sizes and densities without deviating from the scope and nature of the invention described herein. For instance, in FIG. 3 the side weight 35 can be hemispherical versus spherical in FIG. 4. The hemispherically shaped side weight results in more hooking action of the ball than the spherically shaped side weight.

Different hooking actions and rolls of the bowling ball can be achieved in the present invention through various placements of the finger holes 40 and thumb hole 45. For instance, in FIG. 5 the finger holes 40 and thumb hole 45 have been placed such that the side weight 35 is now behind the center weight 25. This creates a different hooking and rolling pattern for a three-quarter roller as the ball proceeds down the alley. The direction of rotation, it should be noted, is from back to front such that the finger holes 40 will move in the direction of the thumb hole 45. Because the side weight 35 is no longer on or near the axis of rotation in the configurations set forth in FIGS. 5 and 6, there will be more rotational inertia and gyration, or rotation, of the bowling ball resulting in less hook and a higher track 55. Since the ball as configured in FIG. 6 has more rotational inertia about the axis of rotation, as determined by a three-quarter roller, and, as such, the gyroscopic effect of the side weight and the center weight is pronounced, thus keeping the ball on a very narrow track. This results in a very true, or straight roll, of the bowling bowl with very little hook. Again, the finger holes are avoided in the process of the roll by the gyroscopic action of the weights and ball. The gyroscopic effect of the side weight 35 and the center weight is much more pronounced in the configuration of FIG. 6 versus FIGS. 3 and 4 where the rotational inertia is not as large.

It is important to emphasize that the preferred embodiment of the aforesaid invention enables sellers of the bowling balls to distribute the same bowling ball drilled to a customer's specification to produce different results.

Although the invention has been described with respect to FIGS. 1 through 6 hereof, inclusive, it should be understood by those skilled in the art that the side weight 35 and the center weight 25 can assume different positions relative to the position of the finger holes 40 and thumb hole 45. In effect, the relative position of the positive weight with respect to the grip, also known as the side weight 35, determines the roll and the action on the bowling ball. The finger holes 40 and the thumb hole 45 define the grip that a bowler has on the bowling ball. This grip can be rotated or placed anywhere from 0° to 90° resulting in numerable grips on, and results from, the same bowling ball. This is readily apparent from an examination of FIGS. 3 through 6, inclusive.

The invention has been described in detail with particular emphasis on the preferred embodiments thereof, but it should be understood that variations and modifications within the spirit and scope of the invention may occur to those skilled in the art to which the invention pertains.

What is claimed is:

1. A bowling ball comprising a generally spherical member, said generally spherical member having a center, said member having a positive half and a negative half, a center weight shaped generally in the form of a segment of a sphere and symmetrically distributed around an axis of rotation, said center weight residing in said negative half of said member, a side weight shaped generally in the form of a segment of a sphere and symmetrically distributed around the axis of rotation, said center weight and said side weight separated from each other, said side weight residing in said positive half of said member, said center weight having a mass, said side weight having a mass, said center weight having a center of gravity, said center of gravity of said center weight residing relatively near said center of said generally spherical member, said side weight having a center of gravity, said center of gravity of said side weight residing relatively far from said center of said generally spherical member, said center of gravity of said center weight residing on the axis of rotation, said center of gravity of said side weight residing on the axis of rotation, said mass of said center weight balancing said mass of said side weight in combination with said center of gravity of said center weight and said center of gravity of said side weight when the axis of rotation is parallel to a surface of a bowling alley, a top weight shaped generally in the form of a segment of a sphere and residing partially in said positive half and partially in said negative half of said member, holes in said generally spherical member for gripping said ball, said holes residing in close proximity to said top weight, said top weight being of a mass generally equal to the mass removed for said holes.

2. A bowling ball as claimed in claim 1 wherein said negative half and said positive half of said member are of uniform density therethrough excepting volumes as defined by said center weight, said side weight, said top weights and said holes.

3. A bowling ball comprising a generally spherical member, said member having a positive half and a negative half, a center weight residing in said negative half of said member, a side weight residing in said positive half of said member, said center weight and said side weight being hemispherically shaped, a top weight residing partially in said positive half and partially in said negative half of said member, finger holes and a thumb hole residing in said generally spherical member, said finger holes and said thumb hole residing in close proximity to said top weight, said top weight having a mass equal to that mass of said member removed through the manufacture of said finger holes and said thumb hole, said side weight and said center weight acting in balanced gyroscopic action during rotation of said bowling ball, said balanced gyroscopic action causing a track so as to avoid said finger holes and said thumb hole, said gyroscopic action increasing linear speed of said bowling ball as it proceeds down a bowling alley.

4. A bowling ball as claimed in claim 3 wherein said balanced gyroscopic action of said bowling ball causing said bowling ball to hook.

5. A bowling ball as claimed in claim 3 wherein said finger holes and thumb holes are oriented rotationally around said top weight in any of a plurality of ways depending on the desired bowling ball action.

6. A bowling ball as claimed in claim 3 wherein said spherical member has an exterior surface, an indicia residing on said exterior surface, said indicia occupying a relative position to said side weight, said finger holes and said thumb hole occupying relative positions to said indicia, said positions of said finger holes and said thumb hole determining action of said bowling ball.

7. A bowling ball as claimed in claim 3 wherein said center weight, said side weight, said top weight, acting, in combination with positioning of said finger holes and said thumb hole with respect to said side weight, to produce an early roll, maximum hook and maximum speed of said bowling ball.

8. A bowling ball comprising a generally spherical member, said member having a positive half and a negative half, a center weight residing in said negative half of said member, a side weight residing in said positive half of said member, a top weight residing partially in said positive half and partially in said negative half of said member, finger holes and a thumb hole residing in said member for gripping said bowling ball, said center weight and said side weight each being hemispherically shaped and spaced from each other, said side weight and said center weight being balanced, said finger holes and said thumb hole residing in close proximity to said top weight, said finger holes and said thumb hole being positioned relative to said side weight.

9. A bowling ball comprising a generally spherical member, said member having a positive half and a negative half, a center weight residing in said negative half of said member, a side weight residing in said positive half of said member, said center weight having a mass, said side weight having a mass, said mass of said center weight being greater than said mass of said side weight, a top weight residing partially in said positive half and partially in said negative half of said member, finger holes and a thumb hole residing in said generally spherical member, said finger holes and said thumb hole reside in close proximity to said top weight, said center weight and said side weight being separated from each other and symmetrically distributed around an axis of rotation, said center weight and said side weight being balanced when said bowling ball is at rest, said center weight and said side weight acting in gyroscopic action during rotation of said bowling ball, said balanced gyroscopic action causing a track so as to avoid said finger holes and said thumb hole.

* * * * *